US007733073B2

(12) United States Patent
Hartlieb

(10) Patent No.: US 7,733,073 B2
(45) Date of Patent: Jun. 8, 2010

(54) CURRENT REGULATOR WITH CURRENT THRESHOLD DEPENDENT DUTY CYCLE

(75) Inventor: Heimo Hartlieb, Graz (AT)

(73) Assignee: Infineon Technologies AG, Neubiberg (DE)

( * ) Notice: Subject to any disclaimer, the term of this patent is extended or adjusted under 35 U.S.C. 154(b) by 451 days.

(21) Appl. No.: 11/864,018

(22) Filed: Sep. 28, 2007

(65) Prior Publication Data

US 2009/0085544 A1 Apr. 2, 2009

(51) Int. Cl.
*G05F 1/56* (2006.01)

(52) U.S. Cl. ..... 323/284; 323/351

(58) Field of Classification Search ..... 323/282, 323/284, 351

See application file for complete search history.

(56) References Cited

U.S. PATENT DOCUMENTS

| | | | | |
|---|---|---|---|---|
| 5,124,616 | A * | 6/1992 | Wrzesinski | 323/284 |
| 5,629,610 | A * | 5/1997 | Pedrazzini et al. | 323/283 |
| 6,747,443 | B2 * | 6/2004 | Balakrishnan et al. | 323/284 |
| 6,833,692 | B2 * | 12/2004 | Balakrishnan et al. | 323/284 |
| 7,061,218 | B2 * | 6/2006 | Ito | 323/351 |
| 7,304,464 | B2 * | 12/2007 | Weng et al. | 323/285 |
| 7,518,348 | B1 * | 4/2009 | Kobayashi | 323/282 |
| 2009/0085546 | A1 * | 4/2009 | Phadke et al. | 323/284 |
| 2009/0322300 | A1 * | 12/2009 | Melanson et al. | 323/284 |

FOREIGN PATENT DOCUMENTS

| | | |
|---|---|---|
| DE | 4423102 | 1/1996 |
| DE | 19754671 | 6/1998 |
| DE | 10242790 | 3/2004 |
| DE | 102005022396 | 11/2006 |
| DE | 102004048706 | 3/2009 |

* cited by examiner

*Primary Examiner*—Jeffrey L Sterrett
(74) *Attorney, Agent, or Firm*—Banner & Witcoff, Ltd.

(57) ABSTRACT

A regulator and a method for regulating a current through a load. The regulator may include, for example, a first circuit portion configured to alternately apply and remove a voltage across the load in accordance with a first signal, the voltage causing a current to flow, and a second circuit portion configured to generate the first signal so as to have a duty cycle that depends upon an amount of the current and a second signal when the amount of current is below a threshold amount, and to generate the first signal so as to have a duty cycle that depends upon the amount of the current but not the second signal when the amount of current exceeds the threshold amount.

23 Claims, 5 Drawing Sheets

CURRENT REGULATOR WITH CURRENT THRESHOLD DEPENDENT DUTY CYCLE

TECHNICAL BACKGROUND

In order to regulate a current through an inductive load, it is known practice to apply a pulse-width-modulated voltage to the load and to set the duty ratio (duty cycle) of the voltage on the basis of an error signal which represents a difference between the current flowing through the load and a desired value.

Inductive loads whose current flow is intended to be regulated include, for example, solenoid valves in hydraulic systems, for example automatic shift transmissions, in motor vehicles. A current which is as constant as possible is intended to flow through the solenoid valves in such a system between individual switching operations, the desired value for this current changing during a switching operation. In order to prevent stopping of mechanical components in such a system, for example when a switching operation does not take place over a relatively long period of time, it is known practice to superimpose a radio-frequency (RF) periodic signal on the desired value. The current flowing through the load then fluctuates periodically in the steady state around a current value predefined by the desired value. The valve position then differs periodically from a position predefined by the desired current value and thus prevents stopping of the valve, the frequency of the radio-frequency signal being higher, however, than the so-called cut-off frequency of the fluid system inside the entire hydraulic system, with the result that the fluctuations in the valve position do not affect the position of the parts controlled by the hydraulic system.

There is a need for a current regulator and a method for regulating current, which provide that, after a change in the desired value, the current is quickly regulated to the changed desired value.

SUMMARY

Various aspects are described herein. According to some aspects a regulator and a method for regulating a current through a load is provided. The regulator may include, for example, a first circuit portion configured to alternately apply and remove a voltage across the load in accordance with a first signal, the voltage causing a current to flow, and a second circuit portion configured to generate the first signal so as to have a duty cycle that depends upon an amount of the current and a second signal when the amount of current is below a threshold amount, and to generate the first signal so as to have a duty cycle that depends upon the amount of the current but not the second signal when the amount of current exceeds the threshold amount.

These and other aspects will be described in greater detail in the following Detailed Description and in the accompanying figures.

BRIEF DESCRIPTION OF THE FIGURES

Examples of various aspects of the present invention are explained in more detail below using figures. The figures are used to explain the basic principle of the invention. Therefore, only the circuit components needed to understand the basic principle are illustrated in the figures. In the figures, unless specified otherwise, identical reference symbols denote identical circuit components and signals with the same meaning.

DETAILED DESCRIPTION

Figure 1:
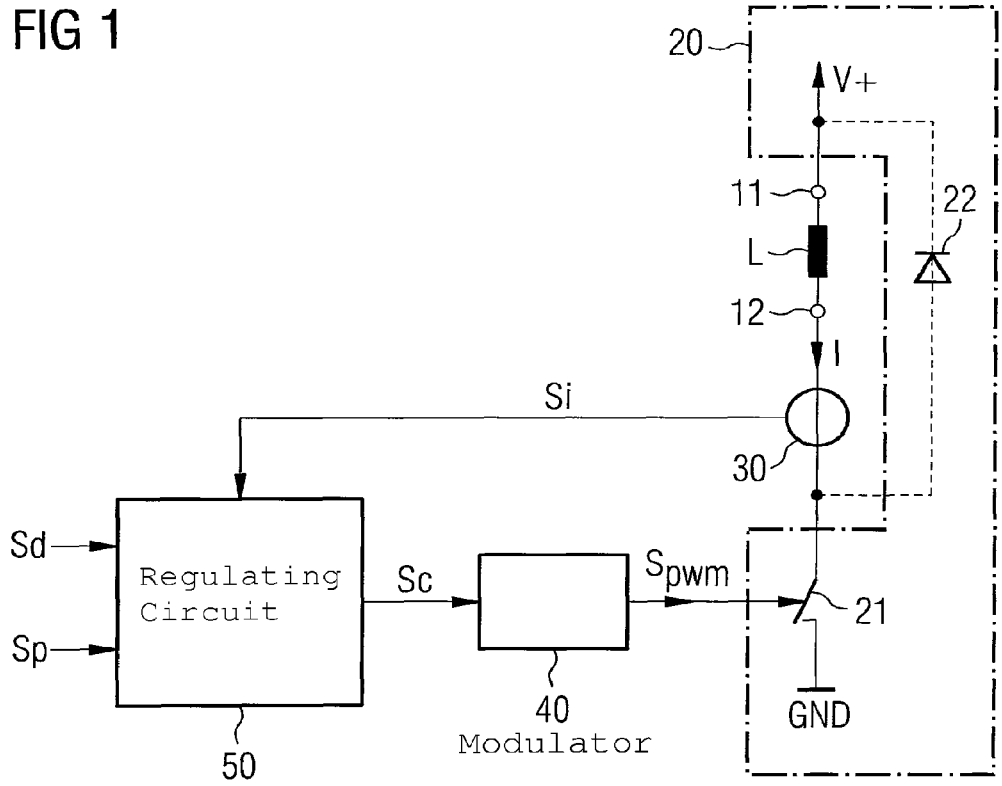
FIG. 1 shows a block diagram of an illustrative embodiment of a current regulator having connection terminals for connecting a load, a current measuring arrangement, a regulating circuit and a pulse width modulator.

FIG. 1 shows a block diagram of an illustrative embodiment of a current regulator for regulating a current I through a load L. This load L is, for example, an inductive load, for example a solenoid valve. The current regulator has connection terminals 11, 12 for connecting the load L and a switching arrangement 20 for applying a pulse-width-modulated supply voltage to the connection terminals 11, 12 on the basis of a pulse-width-modulated signal Spwm. In the example illustrated, the switching arrangement 20 has connection terminals for a positive supply potential V+ and a negative supply potential or reference potential GND as well as a switch 21 which is driven by the pulse-width-modulated signal Spwm. In the example illustrated, the terminal for the positive supply potential V+ is connected to the first connection terminal 11, and the switch 21 is in the form of a low-side switch and is thus connected between the second connection terminal 12 and the terminal for the reference potential GND. When the switch 21 is closed, that is to say turned on, approximately the entire supply voltage which is applied between the terminal for the positive supply potential V+ and the terminal for reference potential GND is across the load L. In contrast, when the switch 21 is open, that is to say turned off, the voltage across the load L is at least approximately zero. Pulse-width-modulated driving of the switch 21 thus results in a pulse-width-modulated supply voltage between the connection terminals 11, 12 and thus across the load L. A duty ratio or duty cycle of the pulse-width-modulated signal Spwm directly corresponds to the duty cycle of the supply voltage in this case.

In the case of an inductive load L, energy is stored in the load L when the switch 21 is turned on. In order to make it possible to commutate off the load when the switch 21 is subsequently turned off, a freewheeling element 22, for example a diode, is connected in parallel with the load L, for example. In this case, the freewheeling element is polarized in such a manner that it can accept a freewheeling current of the inductive load when the switch 21 is turned off.

It should be pointed out that the switching arrangement 20 which is illustrated in FIG. 1 and is intended to apply a pulse-width-modulated supply voltage to the connection terminals 11, 12 should merely be understood as an example. Instead of implementing the switch 21 in the form of a low-side switch, this switch could also be implemented in a corresponding manner in the form of a high-side switch, that is to say it could be arranged between the terminal for the positive supply potential V+ and the first connection terminal 11. In addition, it is possible to use any other desired freewheeling elements or circuits which make it possible to commutate off the inductive load L when the switch is open. One example of such a further circuit for commutating off the inductive load L is a so-called "active zener circuit". Such an active zener circuit turns on the switch 21 in order to make it possible to commutate off the inductive load L as soon as a voltage drop across the load path of the switch exceeds a predefined threshold value when the switch 21 is initially turned off. Such active zener circuits are known in principle, with the result that further explanations in this respect can be omitted.

The task of the current regulator illustrated is to regulate the current I through the load L in such a manner that at least one mean value of this current I corresponds to a desired value represented by a desired value signal Sp over one period duration of the pulse-width-modulated signal Spwm. In order to regulate this current I, the current regulator has a regulating circuit 50 which is supplied with the desired value signal Sp and a current measurement signal Si which is provided by a current measuring arrangement 30. In the example, the current measuring arrangement 30 is connected in series with the switch 21 and provides a current measurement signal Si which is proportional to the current I. Any desired current measuring arrangement which provides a measurement signal that is proportional to a current I flowing through the load L or the switch 21 is suitable as the current measuring arrangement 30.

The regulating circuit 50 generates a regulating signal Sc which is supplied to a pulse width modulator 40 which generates the pulse-width-modulated signal Spwm on the basis of this regulating signal Sc. The regulating signal Sc contains an item of information relating to an instantaneous and/or a past difference between the current I and the desired value signal Sp and uses the pulse width modulator 40 to determine the duty cycle of the pulse-width-modulated signal Spwm. The pulse-width-modulated signal is, for example, a fixed clocked signal with a fixed predefined period duration, and a switched-on duration and a switched-off duration for each drive period. During the switched-on duration, the pulse-width-modulated signal Spwm assumes a switched-on level which turns on the switch 21 and, during the switched-off duration, the pulse-width-modulated signal Spwm assumes a switched-off level which turns off the switch 21. In order to regulate the current draw, the ratio of switched-on duration to the entire period duration, that is to say the duty cycle, can vary in this case.

In this case, the regulating signal Sc is generated by the regulating circuit 50 in such a manner that the switched-on durations of the switch 21 are extended if the regulating signal Sc indicates a current I which is too small in comparison with the desired value and the switched-on durations are shortened if the regulating signal Sc indicates a current I which is too large in comparison with the desired value. The clock frequency at which the pulse-width-modulated signal Spwm is generated is selected in this example in such a manner that a current permanently flows through the load L, that is to say the load is never completely demagnetized during the switched-off durations of the switch 21. The load L is then operated in a continuous current mode.

In the current regulator illustrated in FIG. 1, provision is made for the current I to be regulated in such a manner that the current I fluctuates, with a predefined amplitude and at a predefined frequency, around the desired value when the current regulator is in the steady state. Such periodic fluctuations in the current I are used, for example in the case of inductive loads which are part of a mechanical or hydraulic system, to prevent stopping or jamming of mechanical components of the system. In the case of an inductive load which is in the form of a solenoid valve and is, for example, part of a hydraulic system, the fluctuations in the current result in fluctuations in the valve position which may prevent jamming. In this case, the frequency of the current fluctuations may be so high that the fluctuations in the valve position do not influence the behavior of the hydraulic system itself. The frequency of the current fluctuations may be therefore higher than the cut-off frequency of the entire system.

The amplitude with which, and the frequency at which, the current I is intended to fluctuate around the desired value Sp when the current regulator is in the steady state is determined by a radio-frequency signal Sd which is likewise supplied to the regulating circuit 50. This radio-frequency signal Sd is referred to as an RF signal or "dither" signal below. The current regulator is in a steady state when, after a change in the desired value, the current I has adapted to the new desired value, that is to say when a difference between the current I and the desired value is smaller than a predefined threshold value, for example.

Figure 2:
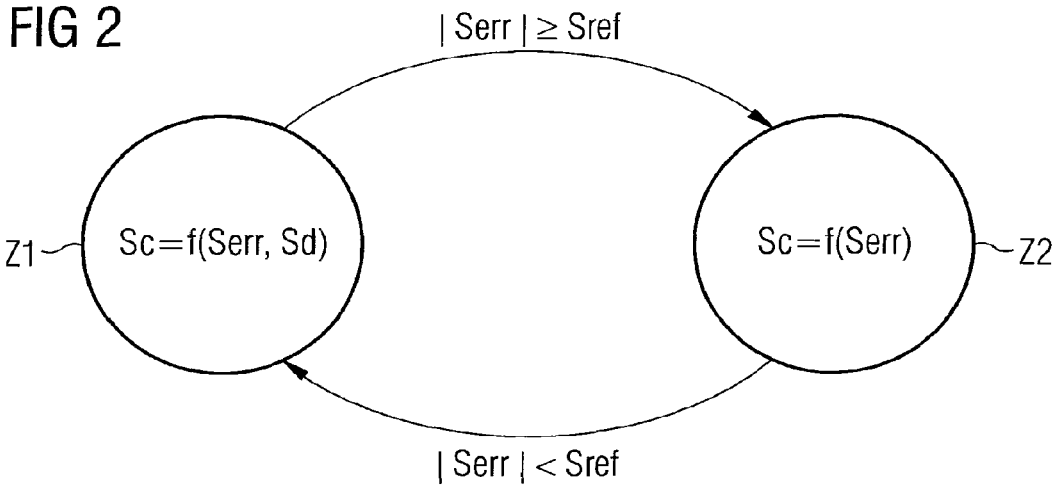
FIG. 2 shows an illustrative state diagram for explaining two different operating states of the regulating circuit.

In order to generate the regulating signal Sc, the regulating circuit 50 generates an error signal which is denoted Serr below and depends on a difference between the desired value signal Sp and the current measurement signal Si and thus represents a difference between the current I flowing through the load L and the desired value. Referring to FIG. 2 showing an illustrative state diagram, the regulating circuit 50 assumes a first operating state Z1 or a second operating state Z2 on the basis of this error signal Serr. The first operating state Z1, which is also referred to as the steady state below, occurs when a magnitude of the error signal Serr is smaller than a predefined reference value. This is synonymous with saying that the current I is within a permissible system deviation around the desired value. The second operating state Z2, which is also referred to as the transition state below, occurs when the magnitude of the error signal Serr is greater than or equal to the reference value Sref. This is synonymous with saying that the current I differs from the desired value by more than the maximum system deviation allowed. The transition state Z2 occurs, for example, after a change in the desired value or the desired value signal Sp or, for example, also when the properties of the load L change abruptly. In order to achieve the quickest possible stabilization after such changes, that is to say to regulate the current I to the changed desired value as quickly as possible, the regulating circuit 50 is designed to generate the regulating signal Sc during the transition state Z2 only on the basis of the error signal Serr but not on the basis of the dither signal Sd. This is based on the knowledge that the radio-frequency amplitude fluctuations of the dither signal would interfere with or slow down the stabilization operation. In contrast, in the steady state Z1, the regulating signal Sc is generated on the basis of the regulating signal Serr and on the basis of the dither signal Sd in order to thus provide that the current fluctuates around the desired value with the amplitude and at the frequency predefined by the dither signal. The following thus applies in the steady state Z1:

$$Sc=f(Serr,Sd) \quad (1a),$$

whereas the following applies in the transition state Z2:

$$Sc=f(Serr) \quad (1b).$$

In this case, f(.) generally denotes a function of the error signal Serr and the dither signal or only the error signal Serr.

As already explained above, on account of the clocked application of the supply voltage to the load L, the current I fluctuates at a frequency which corresponds to the frequency of the pulse-width-modulated signal and is higher than the frequency of the dither signal Sd. In order to avoid fluctuations in the current I which occur within one period duration of the pulse-width-modulated signal Spwm having an adverse effect on the regulating behavior, the regulating circuit 50 does not generate the error signal Serr directly on the basis of the current measurement signal Si but rather on the basis of a mean value Sm of this current measurement signal Si during a predefined mean value duration. This mean value duration may be, for example, at least the period duration of the pulse-width-modulated signal Spwm. The following thus applies to the error signal Serr:

$$Sm = \frac{1}{Tm}\int_{Tm} Si\,dt \tag{2a}$$

in the case of continuous-time averaging in which the current measurement signal Si is integrated over time, where Tm denotes the integration duration or mean value duration. The regulating circuit may be in the form of an analog or a digital regulating circuit. In the case of a digital regulating circuit, samples of the current measurement signal Si are added instead of being integrated in order to determine the mean value. The following applies to the mean value Sm:

$$Sm = \frac{1}{Nm}\sum_{Nm} Si(k) \tag{2b}$$

in the case of discrete-time averaging in which sample signals Si(k) of the mean value signal are processed, where Nm denotes the number of samples taken into account for the respective mean value.

One example provides for the mean value duration Tm to be selected differently for the first and second operating states of the regulating circuit 50, for example in the first operating state Z1 in such a manner that this mean value duration Tm corresponds to one period duration Td of the dither signal or an integer multiple of this period duration Td and in the second operating state Z2 in such a manner that the mean value duration Tm corresponds to one period duration Tpwm of the pulse-width-modulated signal Spwm or an integer multiple of this period duration. In such a case, the following thus applies:

$$Serr = Sp - Sm1 = Sp - \frac{1}{Td}\int_{Td} Si\,dt \tag{3a}$$

in the first operating state Z1 and $$Serr = Sp - Sm2 = Sp - \frac{1}{Tpwm}\int_{Tpwm} Si\,dt \tag{3b}$$

in the second operating state Z2. The following correspondingly applies in the case of a digital regulating circuit:

$$Serr = Sp - \frac{1}{Nd}\sum_{Nd} Si(k) \tag{4a}$$

$$Serr = Sp - \frac{1}{Npwm}\sum_{Npwm} Si(k), \tag{4b}$$

where Nd corresponds to the number of samples of the current measurement signal Si during one period duration of the dither signal Sd and Npwm corresponds to the number of samples of the current measurement signal Si during one period duration of the pulse-width-modulated signal Spwm. The sampling frequency at which the current measurement signal Si is sampled may correspond, for example, to the frequency of the pulse-width-modulated signal Spwm or an integer multiple of this frequency.

The mean value duration which is longer in the first operating state Z1 than in the second operating state Z2 may provide more stable regulation in the first operating state and may also eliminate any influence of the radio-frequency dither signal Sd on the regulating behavior. In contrast, in the transition state Z2, the shorter mean value duration may result in more rapid stabilization to the changed desired value.

In order to determine the regulating signal Sc from the error signal Serr and the dither signal Sd, the dither signal Sd is added, in the first operating state Z1, to a regulating signal Sc that depends on the error signal Serr, for example, that is to say the following applies:

$$Sc=Sc'+Sd=f_{PI}(Serr)+Sd \tag{5a},$$

whereas, in the second operating state Z2, the regulating signal Sc depends only on the error signal Serr, with the result that the following applies:

$$Sc=Sc'=f_{PI}(Serr) \tag{5b}.$$

In this case, Sc' denotes a regulating signal which depends only on the error signal Serr and $f_{PI}$ denotes a regulator function for generating the regulating signal Sc' which depends on the error signal Serr. This function has, for example, a proportional part and an integral part, with the result that the following applies in the case of a continuous-time regulator:

$$Sc'=f_{PI}(Serr)=a\cdot Serr+b\cdot\int Serr\,dt \tag{6a}$$

The following correspondingly applies in the case of a digital regulator:

$$Sc'=f_{PI}(Serr)=a\cdot Serr+b\cdot\Sigma Serr(k) \tag{6b}$$

The method of operation of the regulating circuit 50 explained above is explained below using FIG. 3 which shows illustrative temporal signal profiles of the pulse-width-modulated signal Spwm, of the current I through the load, of the error signal Serr, of the dither signal Sd, of the desired value signal Sp and of the operating state Z of the regulating circuit 50. A clock signal CLKpwm which predefines the frequency of the pulse-width-modulated signal Spwm is also illustrated. For the purposes of explanation, it shall be assumed that upper signal levels or high levels of the pulse-width-modulated signal Spwm illustrated in FIG. 3 represent switch-on levels of this pulse-width-modulated signal Spwm, while lower signal levels or low levels represent switch-off levels.

Figure 3:
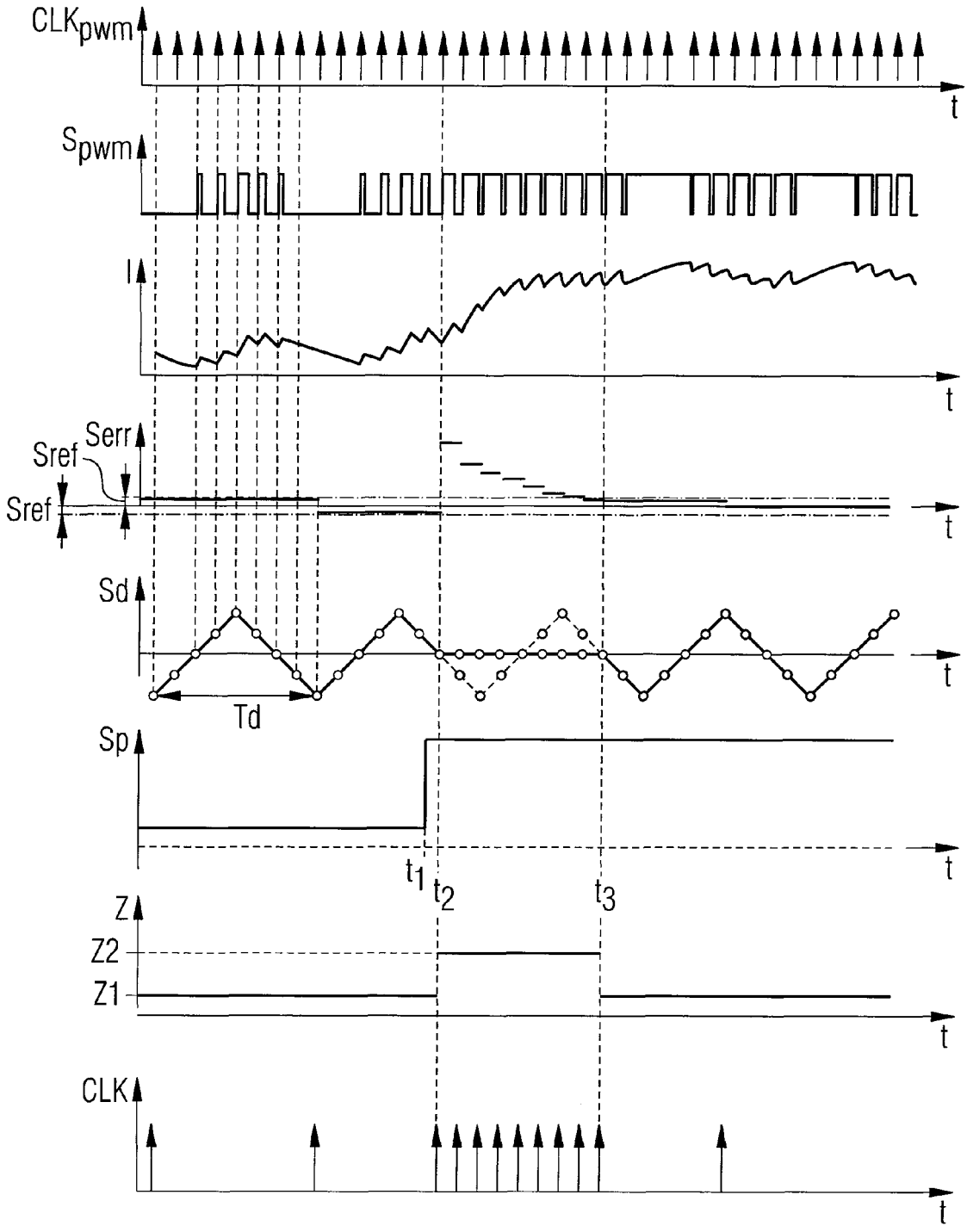
FIG. 3 illustrates the method of operation of the current regulator using illustrative temporal signal profiles.

FIG. 3 shows an illustrative scenario in which the desired value signal Sp has a first signal level until a first point in time t1, suddenly assumes a second signal level—which is higher in the example—at this first point in time t1 and then remains at this signal level. The regulating circuit 50 is in the steady operating state Z1 until this first point in time t1; the regulating signal Sc (not illustrated in FIG. 3) used to generate the pulse-width-modulated signal Spwm depends in this case on the dither signal Sd, with the result that the current I fluctuates around a mid-value following the amplitude of the dither signal Sd. The mid-value around which the current I fluctuates at the frequency of the dither signal Sd corresponds in this case to the first signal level of the desired value signal Sp.

Fluctuations in the current I (which are illustrated in FIG. 3) at a frequency that is higher than the frequency of the dither signal Sd result from the pulse-width-modulated application of the supply voltage to the inductive load L. The current through the inductive load L rises during switched-on durations of the pulse-width-modulated signal Spwm, that is to say during those durations in which the pulse-width-modulated signal assumes a switch-on level, and falls for the remainder of the drive period, that is to say during a duration in which the pulse-width-modulated signal Spwm assumes a switch-off level. A frequency at which the current I fluctuates on account of the application of the pulse-width-modulated supply voltage corresponds in this case to the frequency of the pulse-width-modulated signal Spwm.

During the steady state Z1, the magnitude of the error signal Serr is smaller than the reference value Sref. In the case of the temporal profile of the error signal Serr illustrated in FIG. 3, the error signal Serr is determined, during the steady state, on the basis of the mean value of the current I or the current measurement signal Si over a mean value duration which corresponds to the period duration Td of the dither signal Sd. In the example of the temporal profile illustrated in FIG. 3, the error signal Serr is also determined only once during one period of the dither signal Sd. In this case, the value of the error signal Serr during one period Td of the dither signal Sd is determined on the basis of the mean value of the current I or the current measurement signal Si during the preceding period Td of the dither signal Sd. It is also possible to recalculate the error signal Serr with each period of the pulse-width-modulated signal Spwm, for example, in order to determine the error signal but nevertheless to average it over the duration of one period Td of the dither signal Sd.

The illustration in FIG. 3 is based on a regulating circuit which respectively evaluates the error signal Serr at the beginning of a drive period of the pulse-width-modulated signal Spwm. The sudden change in the desired value signal Sp at the point in time t1 directly results in a sudden change in the error signal Serr, which is detected at a subsequent point in time t2 at which a new drive period of the pulse-width-modulated signal begins. At this point in time, the regulating circuit changes to the second operating state Z2, with the result that the dither signal Sd is masked in order to generate the regulating signal Sc and with the result that the error signal Serr is redetermined with each drive period of the pulse-width-modulated signal Spwm, to be precise on the basis of the mean value of the current or the current measurement signal Si over one period duration Tpwm of the pulse-width-modulated signal Spwm.

Figure 4:
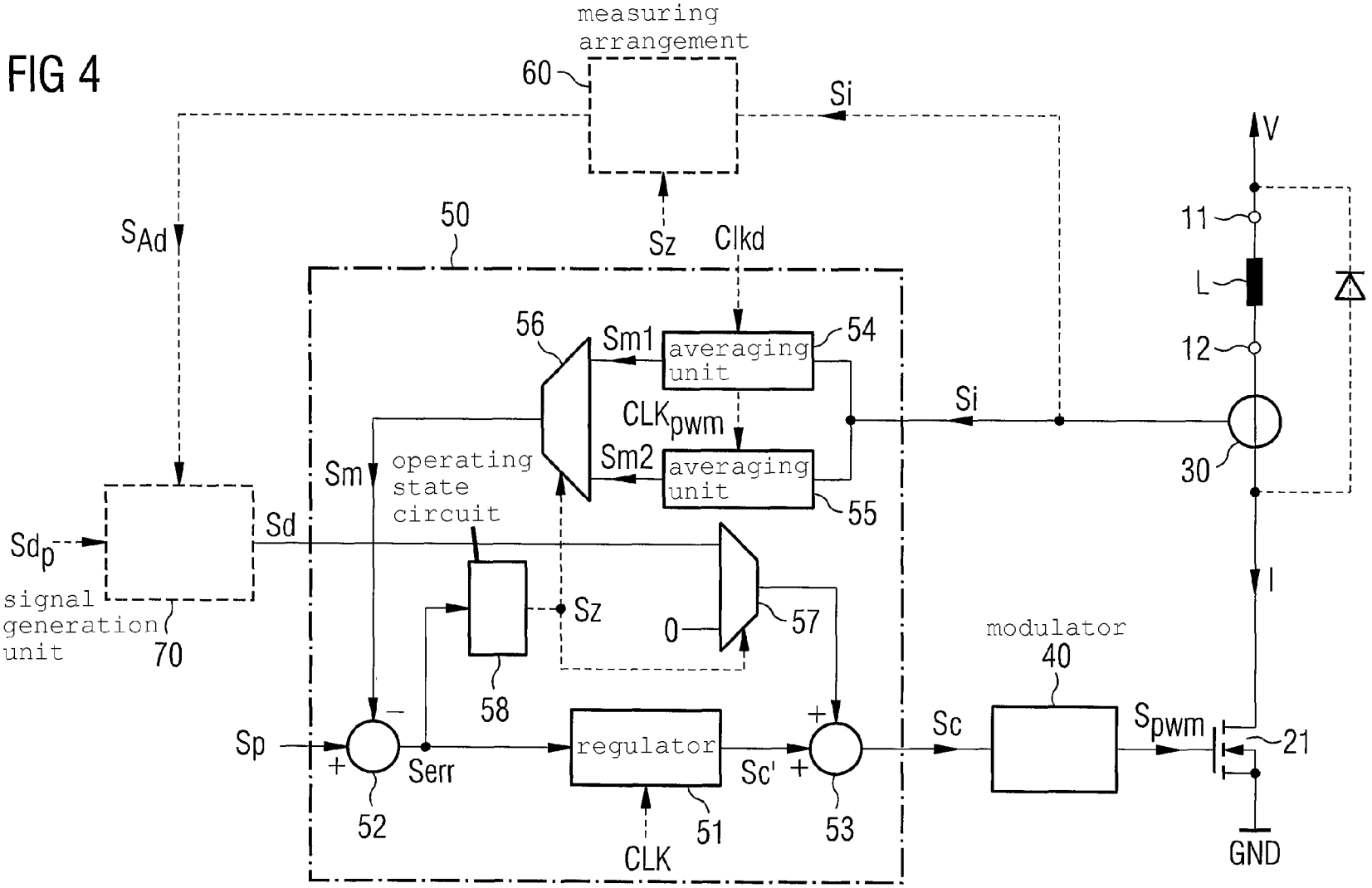
FIG. 4 shows one exemplary implementation of the regulating circuit which has an operating state circuit and a regulator.

FIG. 4 shows one possible exemplary implementation of circuitry for a regulating circuit 50 having the functionality explained above. This regulating circuit 50 has a subtractor 52 which is supplied with the desired value signal Sp and a current mean value signal Sm that depends on the current measurement signal Si. The error signal Serr which represents a difference between the current measurement signal Si or the mean value of this current measurement signal Si and the desired value signal Sp is available at the output of this subtractor 52. This error signal Serr is supplied to an operating state circuit 58 which generates an operating state signal Sz on the basis of the error signal Serr, the operating state signal being able to assume two possible signal levels, a first signal level of which represents the first operating state Z1 and a second signal level of which represents the second operating state Z2 of the regulating circuit 50.

Figure 5:
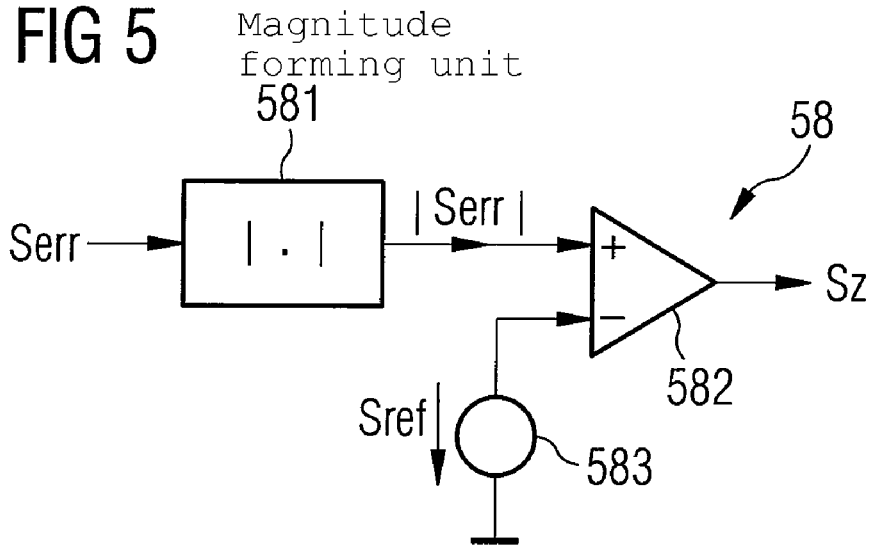
FIG. 5 shows one exemplary implementation of the operating state circuit.

FIG. 5 illustrates one example of such an operating state circuit 58. This operating state circuit 58 has a magnitude forming unit 581 which is supplied with the error signal Serr and provides, at its output, a magnitude signal |Serr| which corresponds to the magnitude of the error signal Serr. The magnitude signal |Serr| is supplied to a first input of a comparator 582 whose other input is supplied with the reference signal Sref generated by a reference signal generation circuit 583. The operating state signal Sz is available at the output of this comparator arrangement 582, said operating state signal assuming a high level in the example illustrated if the magnitude of the error signal Serr is greater than the reference signal Sref and otherwise assuming a low level. In this case, a high level of the operating state signal Sz represents the second operating state, whereas a low level of this operating state signal Sz represents the first operating state.

Referring to FIG. 4, the error signal Serr is supplied to a regulator 51 which generates a regulator output signal Sc' that depends on this error signal Serr. The regulator 51 has, for example, a proportional regulating behavior (P behavior) or a proportional-integral behavior (PI behavior). In the last-mentioned case, the regulator 51 generates the regulator output signal Sc' according to either of equations (6a) and (6b).

The regulating output signal Sc' is supplied to an input of an adder 53 that is connected downstream of the regulator 51. The second input of this adder 53 is supplied with the dither signal Sd on the basis of the operating state. The regulating signal Sc which is generated in accordance with equation (5a) or (5b) and is supplied to the pulse width modulator 40 connected downstream of the regulating circuit 50 is available at the output of this adder 53.

In order to provide the second input signal for the adder 53, a multiplexer 57, one input of which is supplied with the dither signal Sd and the other input of which is supplied with a DC signal having a signal level of zero, is provided in the regulating circuit illustrated. The operating state signal Sz is supplied to this multiplexer 57 as a selection signal. This multiplexer 57 is designed to output the dither signal Sd to the adder 53 in the case of a low level, that is to say in the first operating state Z1. In accordance with equation (5a), the dither signal then corresponds to the sum of the regulating output signal Sc' and the dither signal Sd. In the second operating state Z2, that is to say, in the example illustrated, when the operating state signal Sz assumes a high level, the signal supplied to the adder 53 by the multiplexer 57 is zero. In accordance with equation (5b), the regulating signal Sc then corresponds to the regulator output signal Sc'.

The regulating circuit 50 also has two averaging units which are each supplied with the current measurement signal Si. In this case, a first averaging unit 54 forms the mean value of the current measurement signal Si during a first mean value duration which corresponds, for example, to one period duration Td of the dither signal Sd. A first mean value signal 5 ml is available at the output of this first averaging unit 54. The second averaging unit 55 forms the mean value of the current measurement signal Si during a second mean value duration which corresponds, for example, to the period duration Tpwm of the pulse-width-modulated signal Spwm. A second mean value signal Sm2 is available at the output of this second averaging unit 55. The two averaging units 54, 55 may be implemented in such a manner that they generate the mean values continuously or with each period of the pulse-width-modulated signal Spwm. This corresponds to averaging with a sliding time window. In addition, the two averaging units 54, 55 can also be produced in such a manner that they respectively calculate a mean value only once during one of the averaging durations, with the result that the mean value Sm1, Sm2 available at the output remains constant for this respective averaging duration.

The two mean values Sm1, Sm2 are supplied to inputs of a second multiplexer 56 which is likewise supplied with the operating state signal Sz as a selection signal and at whose output the mean value signal Sm, which is used by the subtractor 52 to determine the error signal Serr, is available. The second multiplexer 56 is designed in such a manner that it outputs the first mean value signal Sm1, which is determined over a longer mean value duration, to the subtractor 52 during a first operating state, that is to say in the case of a low level of the operating state signal Sz, and outputs the second mean value signal Sm2, which is determined over a shorter averaging duration, to the subtractor 52 in the second operating state, that is to say in the case of a high level of the operating state signal Sz, in order to generate the error signal Serr.

The subtractor 52 could also be directly supplied with the current measurement signal, and the averaging which is carried out using the averaging units 54, 55 and the subsequent selection of a mean value using the multiplexer 56 could be applied to the output signal from the subtractor. This would not influence the generation of the error signal Serr. In this case, the error signal is available at the output of the multiplexer.

The regulator 51 may be implemented, for example, in such a manner that it determines the regulating output signal Sc' in accordance with a clock signal CLK, the clock frequency of this clock signal being different for the first and second operating states and being lower in the first operating state than in the second operating state. In the first operating state, the clock frequency CLK corresponds, for example, to the frequency of the dither signal Sd, that is to say the reciprocal of the period duration Td of this dither signal Sd, and corresponds, in the second operating state, to the frequency of the pulse-width-modulated signal Spwm, that is to say the reciprocal of the period duration Tpwm of this pulse-width-modulated signal Spwm. FIG. 3 likewise illustrates a temporal profile of the clock signal. In the case of sliding averaging in which a mean value is determined over the duration of one period Td of the radio-frequency signal with each period of the pulse-width-modulated signal, the clock frequency, that is to say the frequency at which the regulator output signal Sc' is determined, may likewise correspond to the frequency of the pulse-width-modulated signal Spwm in the first operating state.

Figure 6:
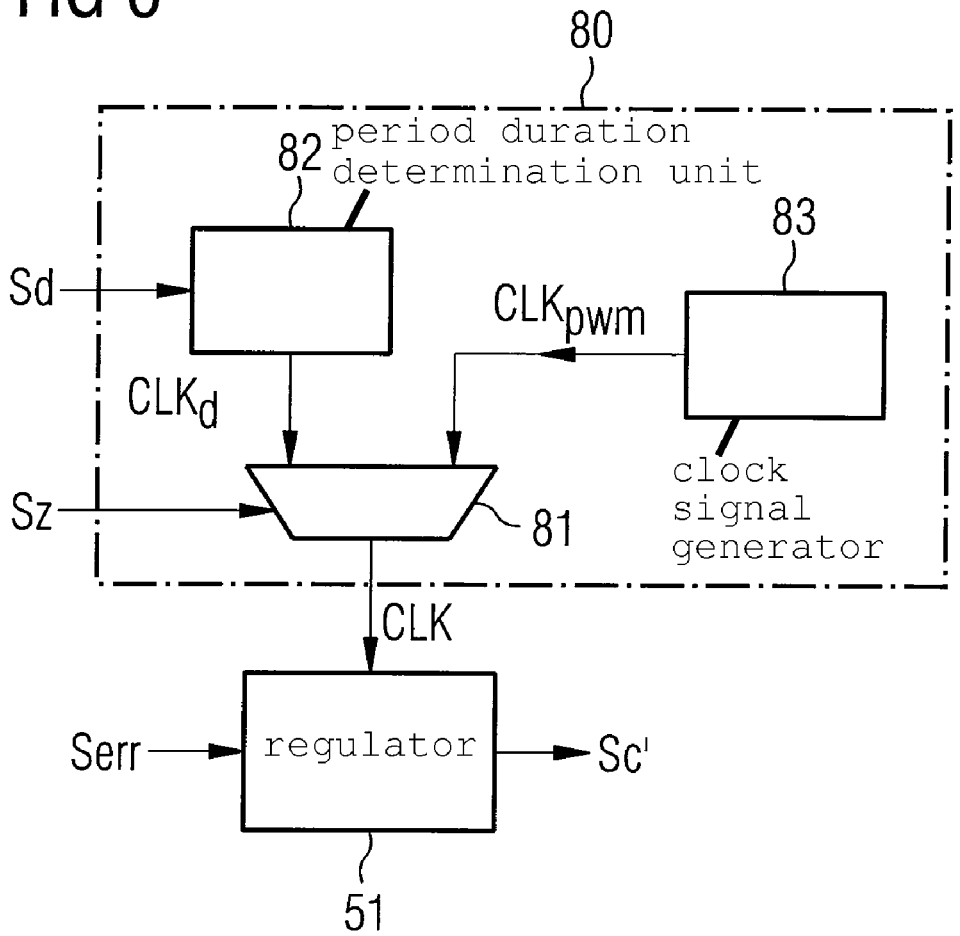
FIG. 6 shows one example of a clock generation circuit for generating a clock signal for the regulator.

This clock signal CLK which is supplied to the regulator 51 is generated, for example, using a clock signal generation circuit 80, as is illustrated in FIG. 6. This clock signal generation circuit 80 has, for example, a first period duration determination unit 82 which is supplied with the dither signal Sd and determines a period duration of the periodic dither signal Sd and generates a first clock signal CLKd whose frequency corresponds to the frequency of the dither signal. This first clock signal CLKd is supplied to a multiplexer 81 together with a clock signal CLKpwm which predefines the clock of the pulse-width-modulated signal Spwm, said multiplexer outputting one of these two clock signals to the regulator 51 as a clock signal CLK in accordance with the operating state signal Sz. In the first operating state, the first clock signal CLKd which is provided by the period duration determination unit 82 is output as the clock signal CLK in this case. In the second operating state, a second clock signal CLKpwm which determines the frequency of the pulse-width-modulated signal Spwm is output as the clock signal CLK. This second clock signal CLKpwm is generated, for example, by a clock signal generator 83 and can also be supplied to the pulse width modulator 40 in a manner which is not illustrated in any more detail.

Referring to FIG. 4, the first clock signal CLKd is supplied, for example, to the first mean value determination unit 54 in order to determine the length of a period duration of the dither signal Sd, whereas the second clock signal CLKpwm is applied to the second averaging unit 55 in order to determine a period duration of the pulse-width-modulated signal.

Figure 7:
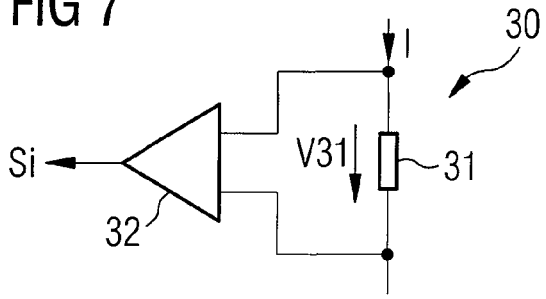
FIG. 7 shows one exemplary implementation of the current measuring arrangement.

Referring to FIG. 7, the current measuring arrangement 30 has, for example, a shunt resistor 31, which is connected in series with the switch 21, and an operational amplifier 32 which taps off a voltage V31 that is applied across the shunt resistor 31 and provides a current measurement signal Si that is proportional to this voltage V31. Any other desired current measuring arrangements can be used to determine the current measurement signal Si.

Figure 8:
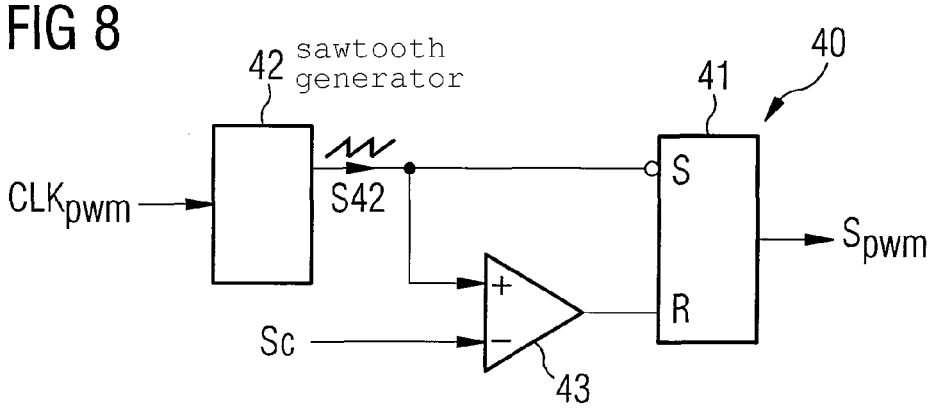
FIG. 8 shows one exemplary implementation of the pulse width modulator.

FIG. 8 illustrates one exemplary implementation of the pulse width modulator 40. This pulse width modulator has a flip-flop 41 having a set input S and a reset input R as well as an output at which the pulse-width-modulated signal Spwm is available.

The pulse width modulator 40 also has a sawtooth generator 42 which generates a sawtooth signal S42 in accordance with the second clock signal CLKpwm. The flip-flop 41 is set, for example, with each falling edge of the sawtooth signal and is respectively reset when the signal level of the sawtooth signal reaches the signal level of the regulating signal Sc. To this end, the sawtooth signal S42 and the regulating signal Sc are compared using a comparator 43. An output signal from this comparator is supplied to the reset input R of the flip-flop 41.

Figure 9:
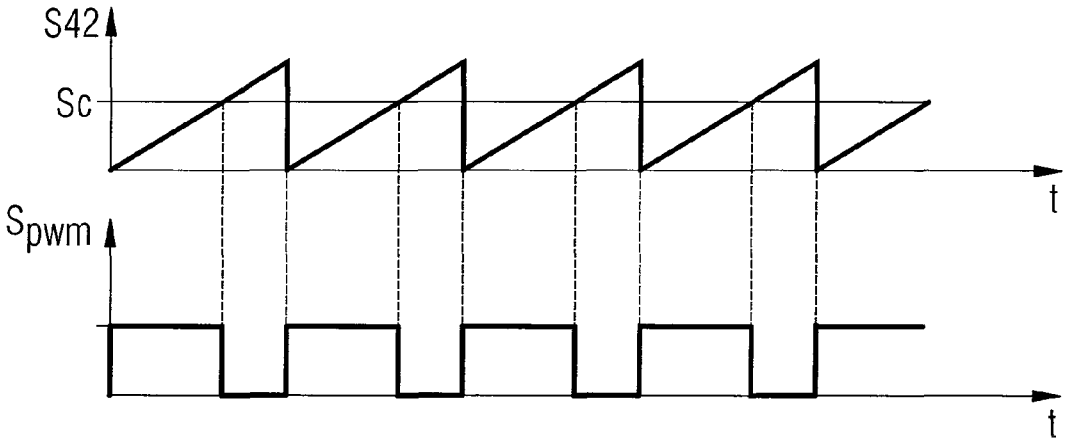
FIG. 9 illustrates a method of operation of the pulse width modulator illustrated in FIG. 8 using illustrative temporal signal profiles.

The method of operation of the pulse width modulator 40 illustrated by way of example in FIG. 7 becomes clear using the temporal profiles of the sawtooth signal S42, of the regulating signal Sc and of the resultant pulse-width-modulated signal Spwm, which are illustrated by way of example in FIG. 9. A period of the pulse-width-modulated signal Spwm respectively begins with a falling edge of the sawtooth signal S42, the pulse-width-modulated signal Spwm assuming a switch-on level—a high level in the example—with this falling edge. The switched-on duration ends when the sawtooth signal S42 has risen to the level of the regulating signal Sc. In this case, the regulator (51 in FIG. 4) is selected in such a manner that an amplitude of the regulating signal Sc increases when the error signal Serr indicates a current I which is too small in comparison with the desired value. As the amplitude of the regulating signal Sc increases, the switched-on duration, and thus the current draw, increases in order to thus regulate the current to the desired value.

Referring to FIG. 4, the current regulator may optionally have a measuring arrangement 60 for determining the amplitude or the signal swing of the current measurement signal Si in the steady state. This measuring arrangement 60 which is supplied with the operating state signal Sz in order to determine the operating state generates an amplitude signal $S_{Ad}$ which depends on this signal swing of the current measurement signal Si. The amplitude signal $S_{Ad}$ is supplied, for example, to a signal generation unit 70 which provides the dither signal. In this case, the amplitude signal $S_{Ad}$ makes it possible to adapt the amplitude of the dither signal.

The dither signal Sd which is added 53 to the regulator output signal Sc downstream of the output of the regulator 51 in the steady state a priori does not correspond to an actual current value. The amplitude of the current fluctuations caused by the dither signal depends, on the one hand, on the regulating path and, on the other hand, on the operating point or the respective desired value. In this case, the signal generation unit 70 uses the amplitude signal $S_{Ad}$ to set the amplitude of the dither signal Sd in such a manner that the amplitude of the signal swing of the load current I, which is caused by the dither signal, corresponds to a desired value. This desired value is supplied to the signal generation unit 70, for example in the form of an amplitude desired value signal $Sd_p$. In summary, the signal generation unit 70 is designed to regulate the amplitude of the fluctuations in the current amplitude, which are caused by the dither signal, to a predefined value. To this end, the signal generation unit 70 has, for example, a regulator (not illustrated) which is supplied with the amplitude signal $S_{Ad}$, as an actual signal, and the desired value signal $Sd_p$ and sets the amplitude of the dither signal. This regulator has, for example, a P behavior, an I behavior or a PI behavior and generates the amplitude on the basis of a difference between the amplitude signal $S_{Ad}$ and the amplitude desired value signal $Sd_p$.

The signal generation unit 70 is illustrated as a separate circuit block in FIG. 4. However, this signal generation unit 70 may also be part of a microcontroller, for example a microcontroller which also generates the desired value signal Sp for the mean current value of the load current. In this case, the regulating algorithm for regulating the amplitude of the dither signal Sd can be implemented using software. However, the signal generation unit 70, including the regulator, may be completely implemented using hardware.

The invention claimed is:

1. A regulator for regulating a current through a load, the regulator comprising:

a first circuit portion configured to alternately apply and remove a voltage across the load in accordance with a first signal, the voltage causing a current to flow; and a second circuit portion configured to generate the first signal so as to have a duty cycle that depends upon an amount of the current and a second signal when the amount of current is below a threshold amount, and to generate the first signal so as to have a duty cycle that depends upon the amount of the current but not the second signal when the amount of current exceeds the threshold amount.

2. The regulator of claim 1, wherein the second signal is a radio frequency signal.

3. The regulator of claim 1, wherein the second signal is a signal independent from the first signal.

4. The regulator of claim 1, wherein the second circuit portion is further configured to determine the amount of current as a mean of a plurality of values of the current over a sliding time window.

5. The regulator of claim 4, wherein the second circuit portion is configured such that the time window has a first width when the amount of current is below the threshold amount and a second width when the amount of current exceeds the threshold amount.

6. The regulator of claim 5, wherein the second circuit portion is configured to set the first width to be equal to an integer multiple of a period of the second signal.

7. The regulator of claim 6, wherein the second circuit portion is configured to set the second width to be equal to an integer multiple of a period of the first signal.

8. The regulator of claim 1, wherein the second circuit portion is configured to determine a difference between the current amount and a predetermined amount, and to generate the first signal such that the duty cycle depends upon the difference.

9. The regulator of claim 1, wherein the first circuit portion comprises a switch having a load path in series with the load, the switch configured to be controlled between an on state and an off state in response to the first signal.

10. A method for regulating a current through a load, the method comprising:

alternately applying and removing a voltage across the load in accordance with a first signal, the voltage causing a current to flow;

generating the first signal so as to have a duty cycle that depends upon an amount of the current and a second signal when the amount of current is below a threshold amount; and generating the first signal so as to have a duty cycle that depends upon the amount of the current but not the second signal when the amount of current exceeds the threshold amount.

11. The method of claim 10, wherein the second signal is a radio frequency signal.

12. The method of claim 10, wherein the second signal is a signal independent from the first signal.

13. The method of claim 10, further comprising determining the amount of current as a mean of a plurality of values of the current over a sliding time window.

14. The method of claim 10, further comprising:

determining the amount of current as a mean of a plurality of values of the current over a sliding time window having a first width when the amount of current is below the threshold amount; and determining the amount of current as a mean of a plurality of values of the current over a sliding time window having a second width when the amount of current exceeds the threshold amount.

15. The method of claim 14, wherein the first width is equal to an integer multiple of a period of the second signal.

16. The method of claim 15, wherein the second width is equal to an integer multiple of a period of the first signal.

17. The method of claim 10, further comprising determining a difference between the current amount and a predetermined amount, wherein generating the first signal comprises generating the first signal such that the duty cycle depends upon the difference.

18. A regulator for regulating a current through a load, the regulator comprising:

a switch configured to switch between an off state and an on state in accordance with a first signal;

a first circuit portion configured to measure a current; and a second circuit portion configured to receive a second signal, to generate the first signal so as to have a duty cycle that depends upon the second signal and an average of the measured current when the average of the measured current is below a threshold amount, and to generate the first signal so as to have a duty cycle that depends upon the average of the measured current, but not the second signal, when the average of the measured current exceeds the threshold amount.

19. The regulator of claim 18, wherein the second signal is a radio frequency signal.

20. The regulator of claim 18, wherein the second circuit portion is configured to determine the average of the measured current over a time window having a first width when the amount of current is below the threshold amount and a second width when the amount of current exceeds the threshold amount.

21. The regulator of claim 20, wherein the second circuit portion is configured to set the first width to be equal to an integer multiple of a period of the second signal.

22. The regulator of claim 21, wherein the second circuit portion is configured to set the second width to be equal to an integer multiple of a period of the first signal.

23. A regulator for regulating a current through a load, the regulator comprising:

means for alternately applying and removing a voltage across the load in accordance with a first signal, the voltage causing a current to flow; and means for generating the first signal so as to have a duty cycle that depends upon an amount of the current and the second signal when the amount of current is below a threshold amount, and for generating the first signal so as to have a duty cycle that depends upon the amount of the current but not the second signal when the amount of current exceeds the threshold amount.

* * * * *